United States Patent [19]

Ashman et al.

[11] Patent Number: 4,497,984

[45] Date of Patent: Feb. 5, 1985

[54] ROTARY SWITCH ASSEMBLY

[75] Inventors: John J. Ashman, Harrisburg; David W. Rupnik, Mechanicsburg, both of Pa.

[73] Assignee: AMP Incorporated, Harrisburg, Pa.

[21] Appl. No.: 511,828

[22] Filed: Jul. 8, 1983

[51] Int. Cl.[3] ..... H01H 19/08

[52] U.S. Cl. ..... 200/11 DA; 200/307

[58] Field of Search ..... 200/11 A, 11 D, 11 DA, 200/307

[56] References Cited

U.S. PATENT DOCUMENTS

| | | | |
|---|---|---|---|
| 3,254,164 | 5/1966 | Lewandowski | 200/11 D |
| 3,268,674 | 8/1966 | Golbeck et al. | 200/11 D |
| 3,736,390 | 5/1973 | Lockard | 200/11 DA |
| 4,032,730 | 6/1977 | Golbeck et al. | 200/11 DA |
| 4,379,955 | 4/1983 | Comerford | 200/11 DA |

OTHER PUBLICATIONS

Davis, "Wafer Switch" IBM Tech. Disclosure Bulletin, vol. 18, No. 10, 3/76—pp. 3405-3406.

*Primary Examiner*—A. D. Pellinen
*Assistant Examiner*—Morris Ginsburg
*Attorney, Agent, or Firm*—Adrian J. LaRue

[57] ABSTRACT

A rotary switch assembly comprises dielectric housing members stacked together, each of the housing members having electrical brush contact members extending into a cavity formed between pairs of housing members. A printed circuit board is disposed in each cavity and has a profiled opening mounting the printed circuit board on a corresponding profiled section of a shaft for rotating the printed circuit boards relative to their respective brush contact members to selected positions for electrical engagement on a selected electrical circuit on the printed circuit boards. Bushing members are located on the printed circuit boards and have profiled bores substantially in coincidence with the profiled openings in the printed circuit boards increasing the area of engagement on the shaft for rotating and accurately positioning the printed circuit boards relative to the brush contact members and adjacent bushing members engage one another to accurately position the printed circuit boards in their respective cavities.

10 Claims, 8 Drawing Figures

ROTARY SWITCH ASSEMBLY

FIELD OF THE INVENTION

The present invention relates to electrical switches and more particularly to a rotary switch assembly.

BACKGROUND OF THE INVENTION

U.S. Pat. No. 3,736,390 discloses a multifunction rotary switch assembly which utilizes rotatable printed circuit boards having circuit patterns thereon that are electrically engageable by electrical brush contact members to perform electrical switching functions depending on the electrical engagement of the brush contact members with the circuit patterns on the printed circuit boards. The printed circuit boards are secured on a shaft which is rotatable by a knob secured thereto. Annular rims are provided by the housing members between which the printed circuit boards are stackably disposed, the rims cooperate to abut and retain the printed circuit boards therebetween and prevent wobbling of the boards.

This arrangement results in frictional problems, especially when several printed circuit boards are used in the switch assembly and also results in deformation of the profiled openings of the boards engaging profiled sections of the shaft on which the boards are mounted thereby rendering operation of the switch assembly very difficult as a result of the friction thus requiring more torque to operate the switch and resulting in inaccurate switch operation when too much play occurs when the profiled openings in the boards are deformed after extensive operation of the switch.

SUMMARY OF THE INVENTION

According to the present invention, a rotary switch assembly comprises dielectric housing members stacked together, each of the housing members having electrical brush contact members extending into a cavity formed between pairs of housing members. A printed circuit board is disposed in each cavity and has a profiled opening mounting the printed circuit board on a corresponding profiled section of a shaft for rotating the printed circuit boards relative to their respective brush contact members to selected positions for electrical engagement on a selected electrical circuit on the printed circuit boards. Bushing members are located on the printed circuit boards and have profiled bores substantially in coincidence with the profiled openings in the printed circuit boards increasing the area of engagement on the shaft for rotating and accurately positioning the printed circuit boards relative to the brush contact members and adjacent bushing members engage one another to accurately position the printed circuit boards in their respective cavities.

BRIEF DESCRIPTION OF THE DRAWINGS

FIG. 8 is a side elevational view of the rotary switch assembly partly in cross section.

DETAILED DESCRIPTION OF THE INVENTION

Figure 1:
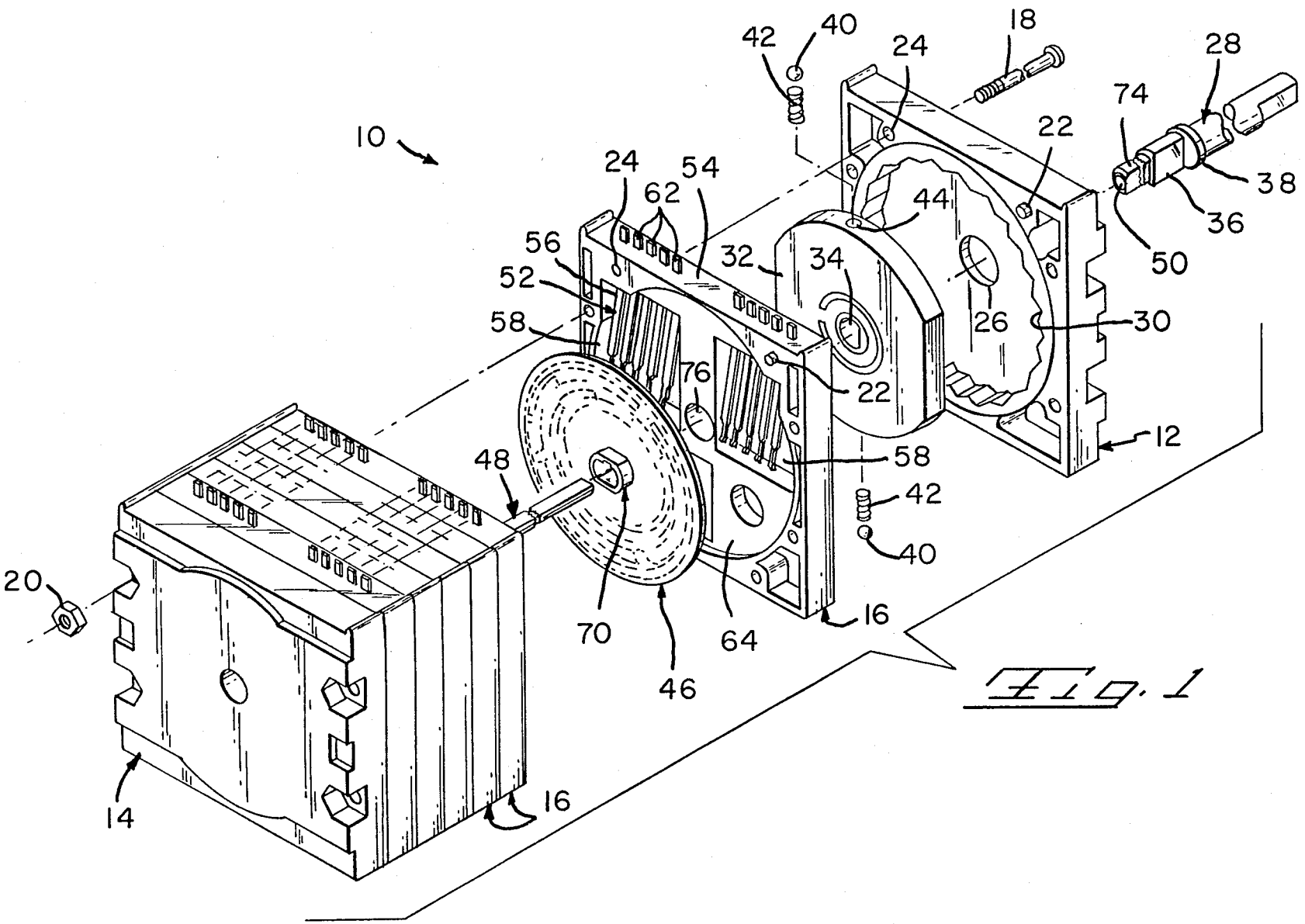
FIG. 1 is a perspective view showing the rotary switch assembly with parts exploded from each other.
Figure 2:
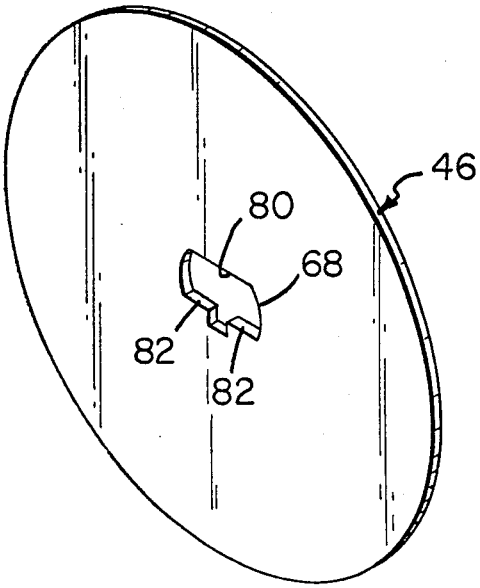
FIG. 2 is a perspective view of a rotary printed circuit board prior to a bushing member being molded thereon.
Figure 3:
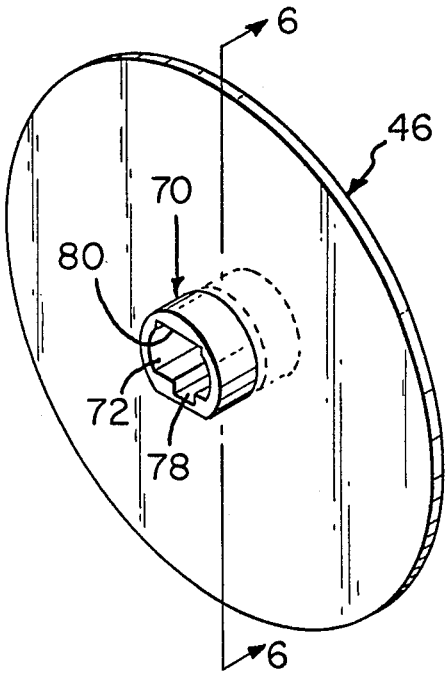
FIG. 3 is a view similar to FIG. 2 showing the bushing member molded in position on the printed circuit board.
Figure 4:
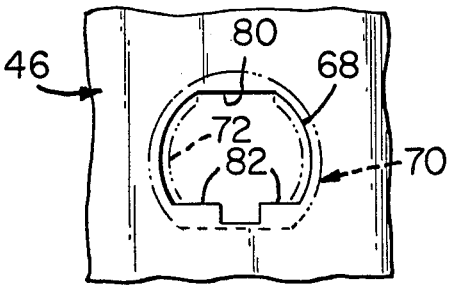
FIG. 4 is a part top plan view of FIG. 3 showing the area the bushing member will cover around the aperture of the printed circuit board.

A rotary switch assembly 10 is shown in FIGS. 1 and 8 and it includes detent housing members 12 and 14 and switch housing members 16 arranged in a stacked relationship between end housing members 12 and 14. Housing members 12, 14 and 16 are molded from a suitable dielectric material. Bolts 18 extend through aligned holes in housing members 12, 14 and 16 and nuts 20 are threadably mounted thereon to secure the housing members 12, 14 and 16 together in a stacked relationship. Inner surfaces of housing members 12 and 14 have projections 22 and holes 24 at the top surfaces thereof which mate with corresponding projections and holes of outermost housing members 16 to orient housing members 12 and 14 relative to housing members 16 to which they are matably engaged. Housing members 16 have projections 22 and holes 24 on each surface so that they are matably oriented to each other when they are stackably connected together.

Housing member 12 has a hole 26 extending through the center thereof through which shaft 28 extends. A detent surface 30 of sawtooth configuration is concentric with hole 26. A detent carrying member 32 has a D-shaped opening 34 extending therethrough which mates with D-shaped section 36 of shaft 28 to rotate member 32 within housing member 12 containing detent surface 30 when shaft 28 is operated by a knob (not shown) secured thereonto. Shaft 28 includes an annular collar 38 which abuts against the inside surface of housing member 12 adjacent hole 26 and member 32 abuts thereagainst. Ball detents 40 along with coil springs 42 are disposed in diametric holes 44 in detent carrying member 32 with coil springs 42 urging ball detents 40 against detent surface 30 to accurately position rotary printed circuit boards 46 mounted on shaft 28 at selected positions to which shaft 28 has been rotated. A like detent arrangement is also disposed in housing member 14 in association with shaft 48 which is telescopically disposed in hole 50 extending through shaft 28.

Switch housing members 16 have brush contact members 52 molded in a cross member 54 which includes spring contact sections 56 cantilevered from cross member 54 and disposed in rectangular openings 58. Contact members 52 are stamped and formed in strip form from a suitable metal strip having desirable spring characteristics. The free ends of spring contact sections 56 are arcuate shaped contact elements 60 that electrically engage one or both surfaces of rotary printed circuit boards 46 as illustrated in FIG. 8. Terminal sections 62 of contact members 52 extend outwardly from housing members 16 for electrical connection with circuit paths of a printed circuit board (not shown). Recesses 64 are formed in each side of housing members 16 so that when a pair of housing members are stacked together as shown in FIG. 8, a cavity 66 is formed in which a printed circuit board 46 is disposed for rotary movement therein and on one or both surfaces of which contact elements 60 of brush contact members 52 are springably and electrically engaged.

Printed circuit boards 46 are circular in configuration and have a printed circuit pattern etched on at least one surface thereof and they are provided with a central profiled opening 68 which includes opposed arcuate surfaces and opposed flat surfaces, one of which has a recess therein as best illustrated in FIGS. 2 through 7.

A bushing member 70 is molded onto each of printed circuit boards 46 as part of profiled openings 68 so that profiled bore 72 extending through bushing member 70 is substantially coincident with opening 68. Thus, bore 72 of a bushing member 70 enables a printed circuit board or boards 46 to be mounted on a D-shaped section 74 of shaft 28 and a similar D-shaped section of shaft 48 which rotates printed circuit boards 46 in cavities 66 relative to brush contact members 52 during the rotational movement of shafts 28 and 48 to selected positions via the knobs secured thereon which are maintained thereat via the detent arrangements in housing members 12 and 14.

Figure 5:
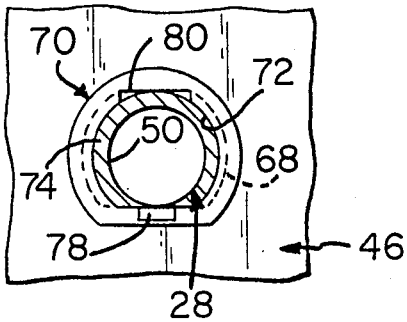
FIG. 5 is a view similar to FIG. 4 showing the relationship between the aperture in the printed circuit board and the bushing member molded thereto in position on a shaft.
Figure 6:
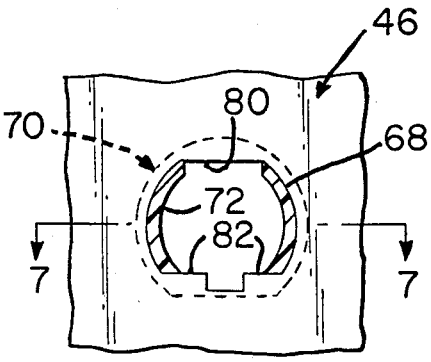
FIG. 6 is a view taken along line 6—6 of FIG. 3.
Figure 7:
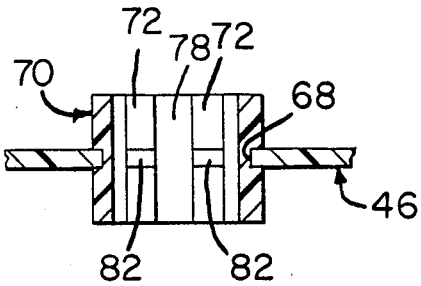
FIG. 7 is a cross-sectional view taken along line 7—7 of FIG. 6.
Figure 3:
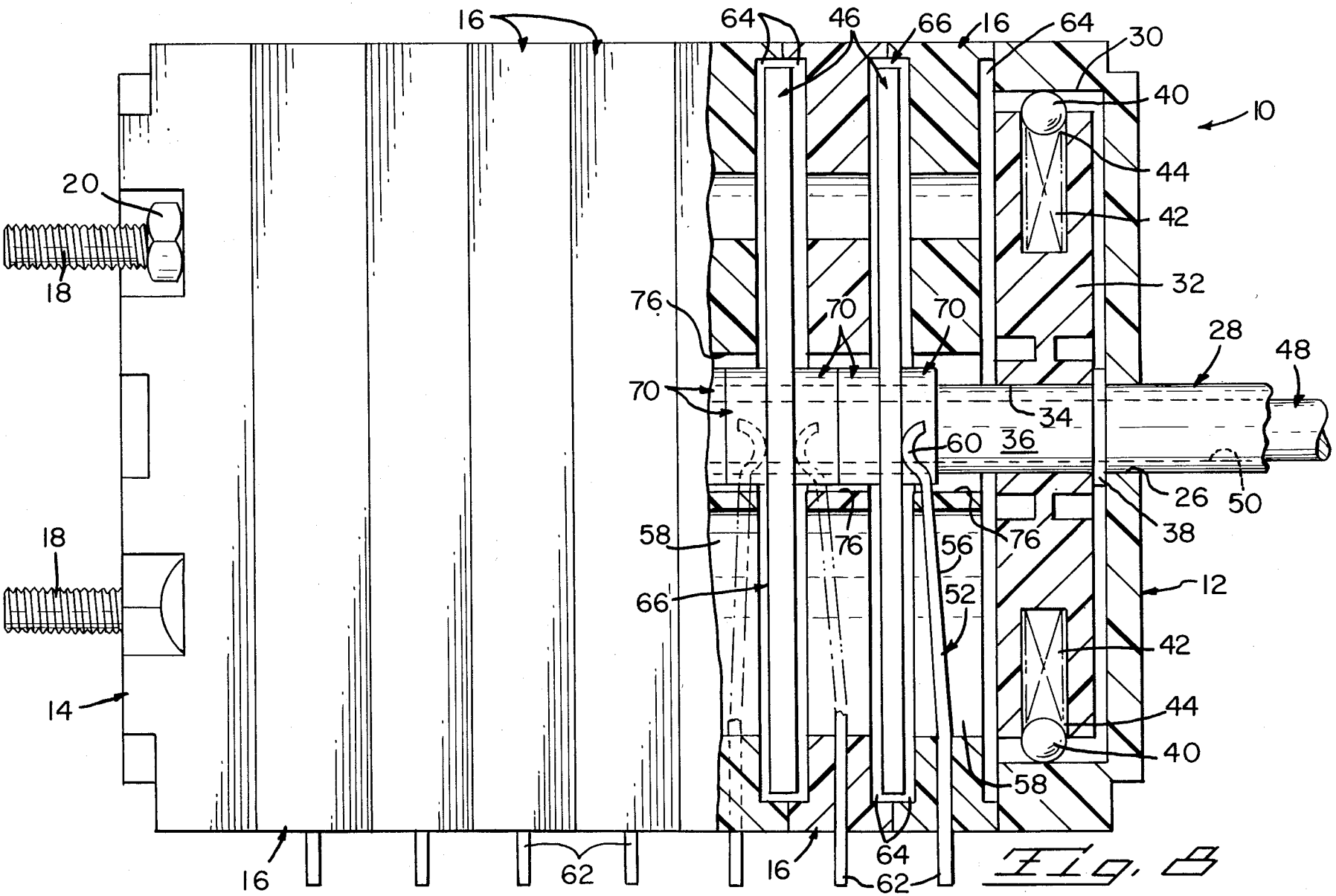

As shown in FIG. 5, bushing member 70 is mounted on the D-shaped section 74 of shaft 28. Bushing member 70 increases substantially the area of engagement with section 74 of shaft 28. This prevents any wobbling of the printed circuit boards 46 on shafts 28 and 48 theby increasing the accurate operation of the rotary switch assembly. Moreover, bushing members 70 engage one another along shafts 28 and 48 on their respective D-shaped sections as shown in FIG. 8 and this arrangement accurately positions rotary printed circuit boards 46 in their respective cavities 66 without engaging housing members 16 because bushing members 70 extend freely through holes 76 in housing members 16. Thus, printed circuit boards 46 rotate freely in cavities 66 except for the engagement of contact elements 60 on one or both surfaces of the printed circuit boards. Thus, the friction is substantially reduced thereby enabling many printed circuit boards to be operated on a single shaft with reduced torque requirements.

In some cases, not all brush contact members 52 in housing member 16 are needed; therefore, the non-required contact members are removed including the spring contact sections 56 and terminal sections 62. Brush contact members 52 are sometimes required for engaging the surface of the printed circuit board that has no circuit pattern theron, especially when only one printed circuit board is mounted on the shaft to balance the operating forces thereon. In such cases, some of the spring contact sections and all of the terminal sections are removed.

As shown in FIG. 5, the configuration of the profiled bore 72 of bushing member 70 in engagement with the D-shaped section 74 of shaft 28 directs the turning forces exerted by shaft 28 at the corners of the flat engaging surfaces of section 74 and bore 72. Recess 78 in the bushing member 70 takes care of any irregularities in the mating flat surfaces which precludes any rocking action between the mating flat surfaces thereby preventing any deformation of the corners of the bushing member so that accurate positioning or registration of the printed circuit board relative to the brush contact members always takes place.

Flat surface 80 opposite recess 78 engages the center of the radiussed surface of D-shaped section 74 of shaft 28 to maintain an equal pressure of the flat surface of section 74 onto the flat surfaces on each side of recess 78. Flat surface 80 and flat surfaces 82 of opening 68 are exposed surfaces that engage respectively the radiussed surface and flat surface of the D-shaped section 74 of shaft 28 along with coincident surfaces of bore 72 of bushing member 70. The opposing arcuate surfaces of bore 72 cover the opposing arcuate surfaces of opening 68 and also engage the radiussed surface of section 74. This arrangement increases the area of engagement with shaft 28 and strengthens the mounting of printed circuit boards 46 on the profiled sections of shafts 28 and 48 thereby enabling the boards to be accurately positioned at selected switch positions relative to brush contact members 52 with minimized friction as well as bushing members 70 abutting each other to accurately position boards 46 in respective cavities 66.

We claim:

1. A rotary switch assembly of the type comprising stacked dielectric housing members, a cavity is formed between pairs of the housing members, rotary printed circuit boards are disposed in respective cavities and have profiled openings mounted on a profiled section of a shaft, electrical brush contact members are mounted in at least one of the pairs of the housing members, spring contact sections of the contact members electrically engage a surface of the printed circuit boards forming electrical circuits based upon the positions to which the printed circuit boards have been selectively moved, characterized in that:

bushing members are located on the respective printed circuit boards and have profiled bores substantially coincident with the profiled openings of the printed circuit boards increasing the area of engagement on the shaft for rotating and accurately positioning the printed circuit boards relative to the brush contact members and adjacent bushing members engage one another to accurately position the printed circuit boards in their respective cavities.

2. A rotary switch assembly as set forth in claim 1, characterized in that said profiled openings in the printed circuit boards and said profiled bores in said bushing members have opposing flat surfaces and opposing arcuate surfaces.

3. A rotary switch assembly as set forth in claim 2, characterized in that one of said flat surfaces has a recess and said opposing arcuate surfaces of said profiled bores cover the opposing arcuate surfaces of said profiled openings.

4. A rotary switch assembly as set forth in claim 3, characterized in that said flat surfaces of said profiled openings are exposed and engage the shaft along with the flat surfaces of said profiled bores.

5. A rotary switch assembly as set forth in claim 1, characterized in that a detent housing member having a detent surface and a detent mechanism mounted on the shaft maintains the shaft and printed circuit boards at selected positions.

6. A rotary switch, comprising:

dielectric housing means stackably secured together and having aligned holes, pairs of said housing means having cavity means therebetween;

shaft means freely extending through said aligned holes of said housing means and having profiled section means extending along said aligned holes;

means mounting said shaft means for rotational movement;

printed circuit board means having surface means on which circuit patterns are disposed and profiled opening means;

bushing means secured on said printed circuit board means and having profiled bore means substantially coincident with said profiled opening means;

said printed circuit board means mounted on said shaft means in said cavity means with said profiled opening means and said profiled bore means engaging said profiled section means, said bushing means engaging each other thereby positioning said printed circuit board means in respective cavity means; and brush contact means mounted on said housing means and including spring contact section means engaging said surface means.

7. A rotary switch as set forth in claim 6, wherein said profiled opening means and said profiled bore means having opposing flat surface means and opposing arcuate surface means.

8. A rotary switch as set forth in claim 7, wherein one of said flat surface means has recess means therein.

9. A rotary switch as set forth in claim 7, wherein the flat surface means of said profiled opening means are exposed and engage the shaft means along with the flat surface means of said profiled bore means.

10. A rotary switch as set forth in claim 6, wherein said mounting means and said shaft means include detent means to maintain said printed circuit board means at the selected switch positions.

* * * * *